US005588807A

United States Patent [19]

Kimura et al.

[11] Patent Number: 5,588,807

[45] Date of Patent: Dec. 31, 1996

[54] SWASH PLATE TYPE VARIABLE DISPLACEMENT COMPRESSOR

[75] Inventors: Kazuya Kimura; Hiroaki Kayukawa; Toru Takeichi; Osamu Hiramatsu, all of Kariya, Japan

[73] Assignee: Kabushiki Kaisha Toyoda Jidoshokki Seisakusho, Kariya, Japan

[21] Appl. No.: 244,448

[22] PCT Filed: Nov. 12, 1993

[86] PCT No.: PCT/JP93/01655

§ 371 Date: Jun. 2, 1994

§ 102(e) Date: Jun. 2, 1994

[87] PCT Pub. No.: WO94/11636

PCT Pub. Date: May 26, 1994

[30] Foreign Application Priority Data

Nov. 12, 1992 [JP] Japan ..... 4-302593

[51] Int. Cl.[6] ..... F04B 1/29

[52] U.S. Cl. ..... 417/222.2; 417/270

[58] Field of Search ..... 417/222.1, 222.2, 417/270; 91/473, 505

[56] References Cited

U.S. PATENT DOCUMENTS

| | | | |
|---|---|---|---|
| 4,428,718 | 1/1984 | Skinner | 417/222.2 |
| 4,723,891 | 2/1988 | Takenaka et al. | 417/222.2 |
| 4,860,549 | 8/1989 | Murayama | 62/115 |
| 5,165,863 | 11/1992 | Taguchi | 417/222.2 |
| 5,240,385 | 8/1993 | Nashiro et al. | 417/222.2 |
| 5,242,274 | 9/1993 | Inoue | 417/222.2 |
| 5,318,410 | 6/1994 | Kawamura et al. | 417/222.2 |

FOREIGN PATENT DOCUMENTS

| | | |
|---|---|---|
| 0318976 | 6/1989 | European Pat. Off. . |
| 3824752 | 1/1990 | Germany . |
| 63-150477 | 6/1988 | Japan . |

*Primary Examiner*—Timothy Thorpe
*Assistant Examiner*—William Wicker
*Attorney, Agent, or Firm*—Brooks Haidt Haffner & Delahunty

[57] ABSTRACT

A swash plate type variable displacement compressor is disclosed for adjusting an inclined angle of a swash plate (13) placed in a crank chamber (2*a*) in accordance with a pressure difference between the crank chamber (2*a*) and a gas suction chamber (4*a*) and for compressing gas supplied to compression chambers (18) from the gas suction chamber (4*a*) by pistons (21) that reciprocate with a stroke according to the inclined angle of the swash plate (13) in order to thereby control a volume of gas to be discharged from a gas discharge chamber (4*b*). A communication passage (23) connects the gas discharge chamber (4*b*) to the gas suction chamber (4*a*), and a branch passage (24) branching from the communication passage (23) is connected to the crank chamber (2*a*). Disposed in the communication passage (23) is a valve (25, 45) which normally blocks the communication passage (23) and opens the communication passage (23) to alter pressure in the crank chamber (2*a*).

8 Claims, 5 Drawing Sheets

SWASH PLATE TYPE VARIABLE DISPLACEMENT COMPRESSOR

TECHNICAL FIELD

The present invention relates to a swash plate type variable displacement compressor which is used to compress a refrigerant gas or the like.

BACKGROUND ART

One common type of compressor used for vehicular air conditioning utilizes a swash plate in a crank chamber. Some compressors of this type are responsive to both suction pressure and discharge pressure. These compressors effectively regulate the pressure in the crank chamber with respect to the suction pressure to alter the inclined angle of the swash plate in order to change the compressor's discharge volume.

The above type of compressor is disclosed in, for example, U.S. Pat. No. 4,428,718. This compressor is designed in such a way that a bellows expands to actuate a valve mechanism to decrease the area of a second passage between a suction chamber and the crank chamber. This occurs in response to variations in the balance between the suction pressure and atmospheric pressure. This could occur as the result of a decrease in the cooling load caused by lowering room temperature of the vehicle or as a result of a decrease in suction pressure caused by the compressor's fast rotation. A first passage between a discharge chamber and the crank chamber is opened by another valve mechanism to raise the crank-chamber pressure, thus increasing the difference between the crank-chamber pressure and the suction pressure. Accordingly, the pressure acting on the back of a piston increases and thereby reduces the stroke of that piston. The inclined angle of the swash plate consequently decreases which prevents reductions from being made in the suction pressure. This effectively reduces the overall displacement of the compressor.

In the above compressor, the discharge chamber communicates with the crank chamber through the first passage. The second passage guides the refrigerant gas and extends from the crank chamber to the suction chamber. The refrigerant gas, supplied from the discharge chamber to the crank chamber via the first passage, circulates in the crank chamber and then travels to the suction chamber from the crank chamber via the second passage. As the refrigerant gas passes through the crank chamber, a lubricating oil mist flows into the suction chamber. This moving refrigerant gas reduces the amount of the lubricating oil inside the crank chamber. This reduction of lubricating oil contributes to the wearing out of driving component portions of the crank chamber as for example the swash plate. Moreover, the lubricating oil that flows out of the compressor reduces the heat exchange effectiveness of the condenser and evaporator and thereby decreases the compressor's cooling efficiency.

It is therefore an object of the present invention to provide a swash plate type variable displacement compressor which can secure a lubricating oil in the crank chamber to maintain the high durability of the compressor's internal mechanism.

It is another object of the present invention to provide a swash plate type variable displacement compressor which has an excellent cooling efficiency.

DISCLOSURE OF THE INVENTION

According to the present invention, a variable displacement compressor is provided for adjusting the inclined angle of a swash plate placed in a crank chamber in accordance with a pressure difference between the crank chamber and a gas suction chamber and for compressing gas supplied to compression chambers from the gas suction chamber by pistons that reciprocate with a stroke according to the inclined angle of the swash plate and thereby to control a volume of gas to be discharged from a gas discharge chamber. The compressor comprises a communication passage for connecting the gas discharge chamber to the gas suction chamber, a branch passage branching from the communication passage and connected to the crank chamber, and valve means, disposed in the communication passage, for opening or closing the communication passage to alter pressure in the crank chamber.

With the above structure, when there is any need to alter the pressure in the crank chamber, the valve means opens or closes the communication passage. The inclined angle of the swash plate is adjusted in accordance with a change in pressure in the crank chamber. Accordingly, the reciprocating stroke of the pistons is changed to keep the discharge volume of the compressor at a suitable value.

PREFERRED EMBODIMENTS OF THE INVENTION

A first embodiment of the present invention will now be described referring to FIGS. 1 through 3.

Figure 2:
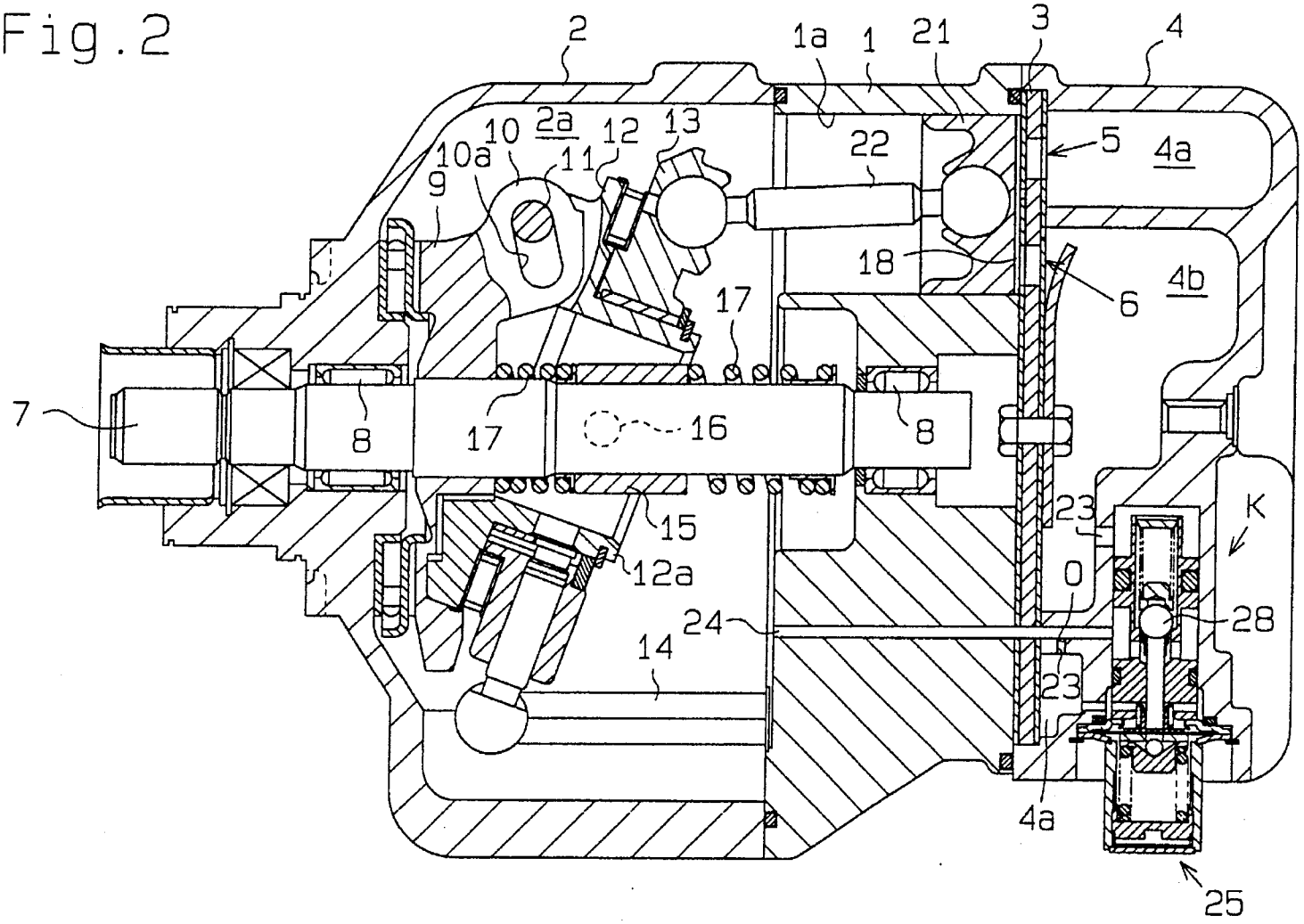
FIG. 2 is a vertical cross-sectional view showing the overall compressor.
Figure 3:
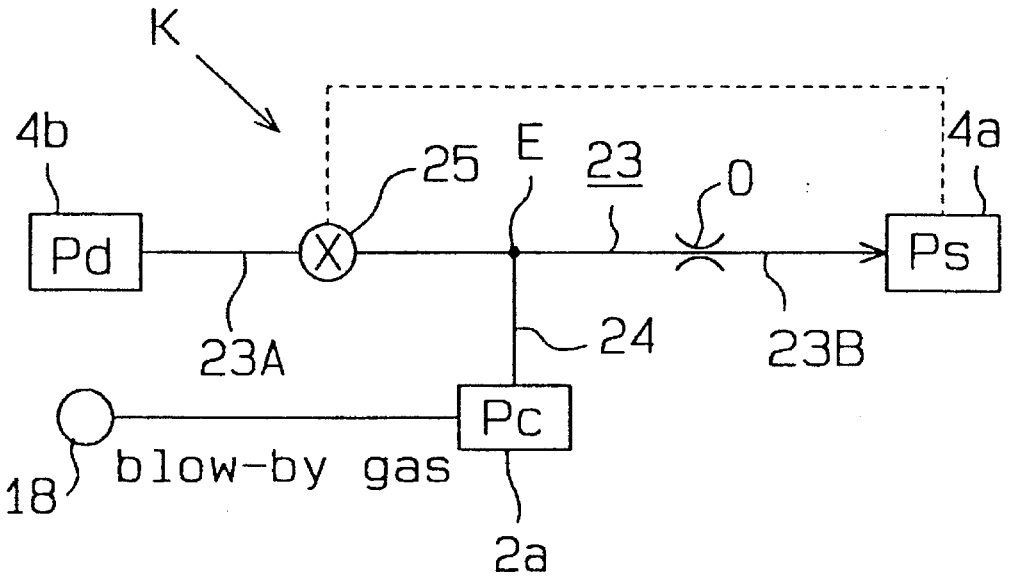
FIG. 3 is a block circuit diagram showing the relation among a discharge chamber, a crank chamber, a suction chamber and the passage switching valve.

As shown in FIG. 2, a front housing 2 is secured to the front end portion of a cylinder block 1. A rear housing 4 is secured via a valve plate 3 to the rear end of the cylinder block 1. A suction chamber **4*a* and a discharge chamber 4*b* are formed in the rear housing 4. Cylinder bores la are formed in the cylinder block 1, and compression chambers 18, whose volumes change with the movement of pistons 21, to be described later, are formed in the cylinder bores 1*a*. The valve plate 3 is provided with a suction valve mechanism 5 which can supply a refrigerant gas to the compression chambers 18 from the suction chamber 4*a*. The valve plate 3 is also provided with a discharge valve mechanism 6 which can discharge the refrigerant gas, compressed in the cylinder bores 1*a*, to the discharge chamber 4*b***.

A drive shaft 7 is supported in the center portions of the cylinder block 1 and front housing 2 by bearings 8. A rotary body 9, which constitutes a driving mechanism, is securely fitted over the middle portion of the drive shaft 7, with an arm 10 integrally formed on its outer surface. An elongated hole **10*a* is formed to extend obliquely along the arm 10, and a pin 11 is integrally formed on a drive plate 12. With the pin 11 fitted in the elongated hole 10***a*, the drive plate 12 is coupled to the arm 10. A swash plate 13 is coupled to a boss portion 12*a* of this drive plate 12 so that it is relatively rotatable. A rotation inhibiting rod 14, fixed to the cylinder block 1 and front housing 2, is coupled to the swash plate 13, so that the swash plate 13 is prevented from rotating and is allowed to tilt only forward and backward.

A slider 15 is supported on the drive shaft 7 to be movable back and forth in the axial direction, and is coupled to the boss portion 12*a* of the drive plate 2 by a coupling pin 16. The slider 15 is continuously urged by a spring 17, provided on the drive shaft 7, so as to set the swash plate 13 and drive plate to the position where the inclined angle becomes the largest. The swash plate 13 is coupled to a plurality of pistons 21, placed in the cylinder bores 1*a*, via piston rods 22.

When the rotary body 9 and drive plate 12 rotate together, due to the rotation of the drive shaft 7 driven by the engine, the swash plate 13 swings forward and backward in a non-rotational state and the pistons 21 reciprocate in the cylinder bores 1*a* via the piston rods 22. Accordingly, the gas supplied from the suction chamber 4*a* is compressed in the compression chambers 18 in the cylinder bores 1*a* and then is discharged to the discharge chamber 4*b*. At the time of this compression, pressure Pc in a crank chamber 2*a* increases due to a blow-by gas which leaks from between the outer surface of the piston 21 and the inner wall of the cylinder bore 1*a* as briefly illustrated in FIG. 3. This pressure increase is adjusted by a displacement control mechanism K.

The displacement control mechanism K will now be described. The discharge chamber 4*b* and the suction chamber 4*a* are connected by a communication passage 23 formed in the rear housing 4. A valve 25 and a restriction O are provided midway along the passage 23. The valve 25 permits or blocks the communication of the discharge chamber 4*b* with the crank chamber 2*a* in accordance with pressure Ps in the suction chamber 4*a*. The restriction O is set for the cross-sectional area of the passage which is necessary to allow the blow-by gas, which has entered the crank chamber 2*a*, to escape into the suction chamber 4*a*. A point E is connected midway in the communication passage 23 between the valve 25 and the restriction O to the crank chamber 2*a* by a single branch passage 24, as shown in FIG. 1. In this embodiment, the communication passage upstream of the middle point E is denoted by "23A" and the communication passage downstream thereof is denoted by "23B".

The structure of the valve 25 will now be explained with reference to FIG. 1. A valve seat 27 is formed in a valve assembly 26 disposed in an attachment hole 4*c* in the rear housing 4. A spherical valve body 28, disposed in a valve seat 29, normally abuts on the valve seat 27 by an urging spring 30 to close the communication passage 23A. In FIG. 1, "31" denotes a fixed spring seat and "32" is a movable spring seat. An actuation rod 33 is fitted in an insertion hole 26*a* at the lower portion of the valve assembly 26 to be able to lift up the valve body 28. The lower end portion of the actuation rod 33 abuts on the top of a diaphragm 34, provided at the lower portion of the valve assembly 26, via a spring seat 35. The actuation rod 33 is urged downward in a direction to move away from the valve body 28 by a spring 36 disposed between the valve assembly 26 and the spring seat 35. A pressure sensitive chamber 37, defined over the diaphragm 34, communicates with the suction chamber 4*a* via a passage 38.

A case 39 which forms a constant pressure chamber 39*a* is secured to the bottom of the diaphragm 34. A compression spring 40 disposed between a fixed spring seat 41 and a movable spring seat 42 in this constant pressure chamber 39*a* applies upward force to the diaphragm 34. The force of the compression spring 40 is smaller than the total force of the springs 30 and 36, so that the diaphragm 34 is normally held at the lowermost position. When the suction pressure Ps in the pressure sensitive chamber 37 falls, the diaphragm 34 moves upward against the forces of the springs 30 and 36, causing the actuation rod 33 to move the valve body 28 in a direction opening the communication passage 23A.

A description will now be given of the action of the thus constituted swash plate type variable displacement compressor.

Figure 1:
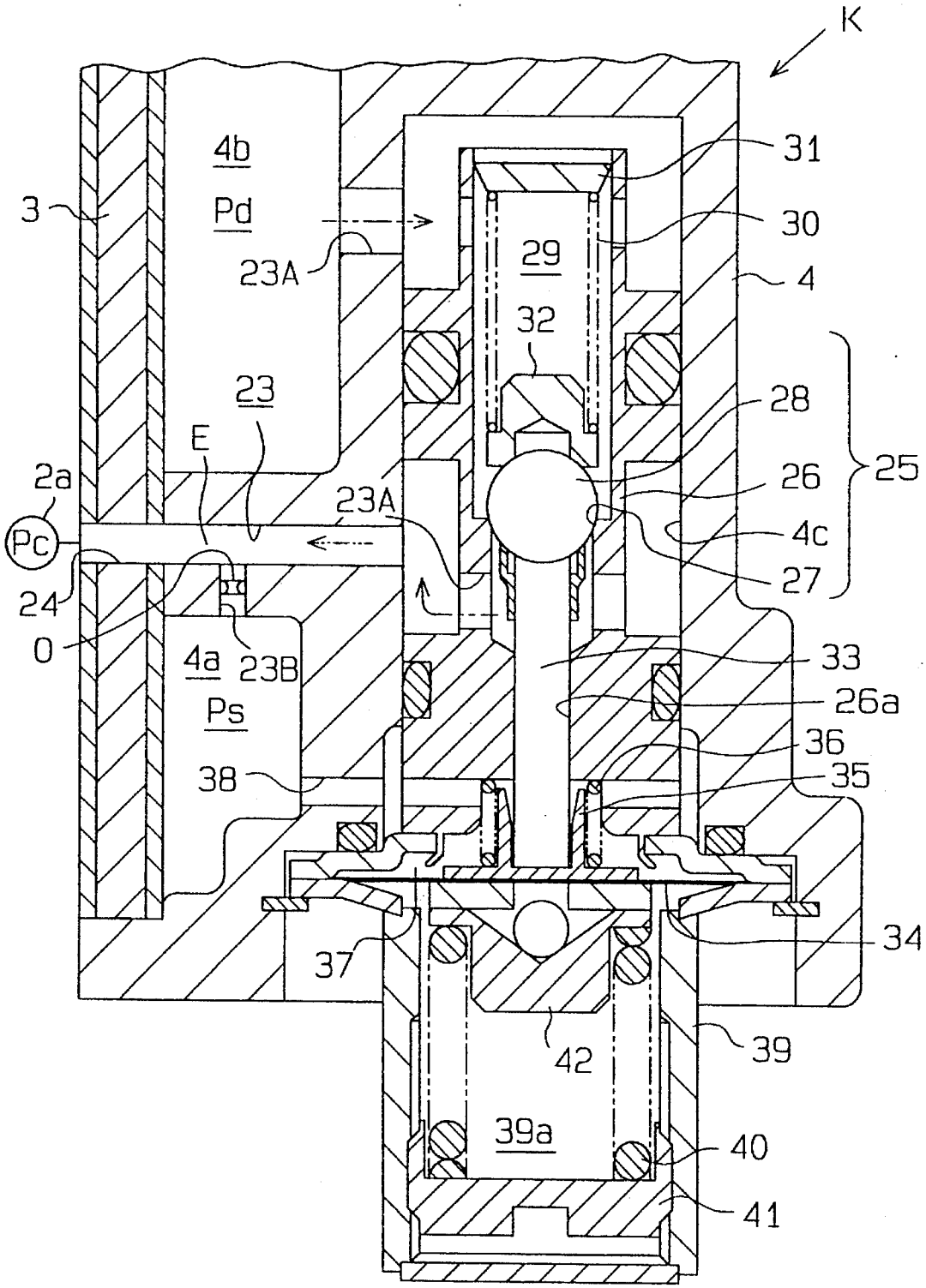
FIG. 1 is a vertical cross-sectional view showing a passage switching valve of a compressor according to a first embodiment of the present invention.

Referring to FIG. 1, when the compressor is not running, the pressure Ps in the suction chamber 4*a*, the pressure Pd in the discharge chamber 4*b* and the pressure Pc in the crank chamber 2*a* are kept at the same level. Consequently, the forces of the springs 30, 36 and 40 are balanced and the valve body 28 of the valve 25 abuts on the valve seat 27, closing the upstream communication passage 23A.

Under these conditions, when the compressor is activated, the rotary body 9 and drive plate 12 are rotated by the drive shaft 7, causing the swash plate 13 to rock and the pistons 21 to reciprocate in the cylinder bores 1*a* via the piston rods 22. Consequently, the refrigerant gas, supplied into the compression chambers 18 in the cylinder bores 1*a* from the suction chamber 4*a*, is compressed and is discharged to the discharge chamber 4*b*.

Given high vehicle temperatures, the cooling load at the compressor's initial operation as well as the suction pressure Ps is high. High suction pressure Ps in the pressure sensitive chamber 37 causes the valve body 28 to keep the upstream communication passage 23A closed.

The blow-by gas which enters the crank chamber 2*a* from the compression chambers 18 in the cylinder bores 1*a* acts in the direction to increase the pressure Pc in the crank chamber 2*a*. Since this gas flows into the suction chamber 4*a* from the crank chamber 2*a* via both the branch passage 24 and the restriction O in the downstream communication passage 23B, the difference ΔPcs between the crank-chamber pressure Pc and the suction pressure Ps will not change. The compressor's operation therefore continues at maximum displacement with the swash plate 13 inclined to a maximum inclined angle.

Given the above compressor operation, the temperature in the vehicle will fall, thus lowering the cooling load. Consequently, the pressure of the refrigerant gas that expands from the evaporator will drop. This reduces the suction pressure Ps and decreases the pressure in the pressure sensitive chamber 37 in the passage switching valve 25. Accordingly, the actuation rod 33 moves upward by the spring 40, so that the valve body 28 opens the upstream communication passage 23A. Consequently, the refrigerant gas under high pressure is supplied to the crank chamber 2*a* from the discharge chamber 4*b* via the upstream communication passage 23A and the branch passage 24. At this time, the restriction O inhibits the high-pressure refrigerant gas from flowing into the suction chamber 4*a*.

As a result, the crank-chamber pressure Pc rises, increasing the difference ΔPcs between the crank-chamber pressure Pc and suction pressure Ps, which respectively act on the front and rear faces of each piston 21. Thus, the stroke of the piston 21 decreases and the swash plate 13 receives a bending moment about the coupling pin 11 in the direction to reduce the inclined angle in FIG. 2, so that the discharge amount of the refrigerant gas decreases. The cooling performance, therefore, decreases in accordance with the room temperature or the cooling load, and control is then needed to increase the suction pressure Ps.

When the valve body 28 of the passage switching valve 25 is open, the refrigerant gas is supplied to the crank chamber 2*a* from the discharge chamber 4*b* via both the downstream communication passage 23A and branch passage 24. As illustrated by the block diagram in FIG. 3, this refrigerant gas enters or leaves from the crank chamber 2*a* via the single branch passage 24. The refrigerant gas flows into the branch passage 24 without entering the suction chamber 4*a* due to the restriction O provided in the downstream communication passage 23*b*.

According to this embodiment, the circulation of the refrigerant gas into the crank chamber 2*a* will not occur, unlike in the prior art where the gas, after entering the crank chamber 2*a*, is discharged into the suction chamber 4*a* via another passage. Therefore, the circulation of the refrigerant gas and the flow of the lubricating oil to the suction chamber 4*a* from the crank chamber 2*a* are suppressed. The lubricating performance in the compressor can thus be improved.

A second embodiment of the present invention will now be described with reference to FIGS. 4 and 5.

Figure 4:
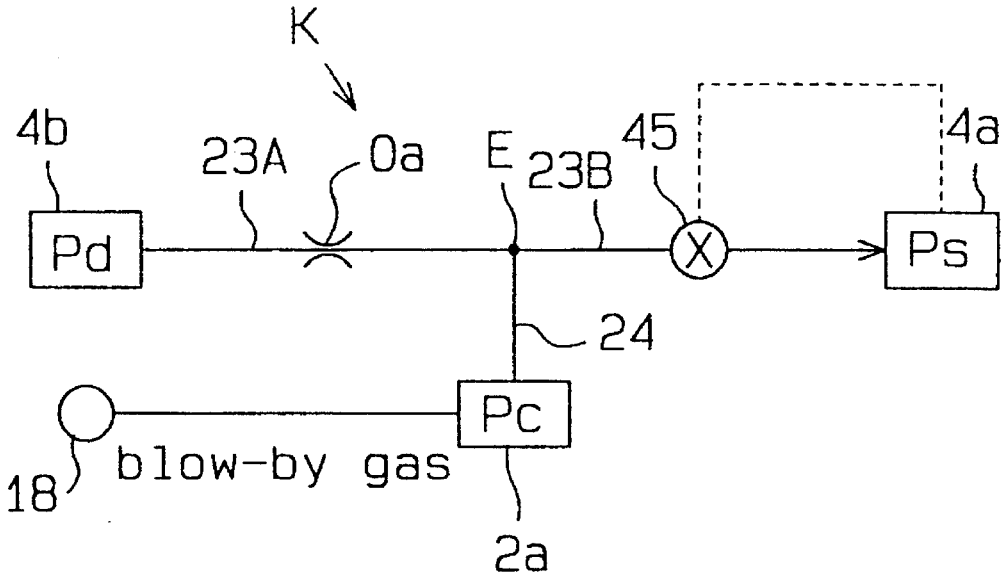
FIG. 4 is a block circuit diagram showing the relation among a discharge chamber, a crank chamber, a suction chamber and a valve according to a second embodiment of the present invention.
Figure 5:
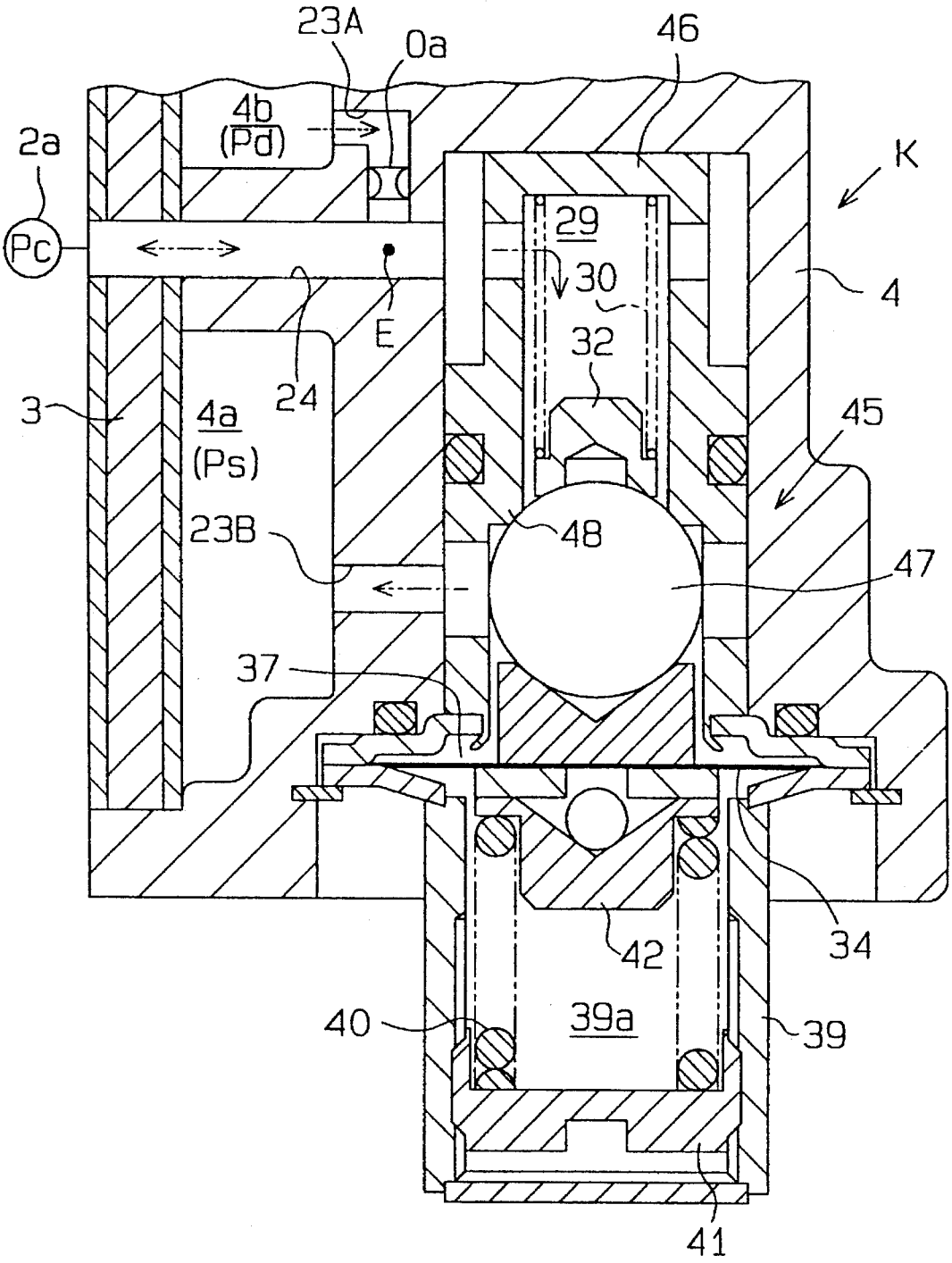
FIG. 5 is a vertical cross-sectional view of the valve according to the second embodiment.

In the second embodiment, as shown in FIG. 4, a restriction Oa is provided in the upstream communication passage 23A with a valve 45 disposed in a midway point in the downstream communication passage 23B. As shown in FIG. 5, this valve 45 has a spherical valve body 47 in a casing 46, which closes the downstream communication passage 23B, and is normally urged to close a valve seat 48 by a spring 40. The same reference numerals as used for the first embodiment are used for the second embodiment to denote the members having the same functions as those of the first embodiment.

When the compressor runs with the maximum displacement in the second embodiment, therefore, refrigerant gas is supplied from the discharge chamber 4*b* to the crank chamber 2*a* via the upstream communication passage 23A and the restriction Oa, other than the blow-by gas from the compression chambers 18. When the crank-chamber pressure Pc gradually rises and becomes a set value, refrigerant gas, in an amount corresponding to the excessive pressure in the crank chamber 2*a*, enters the valve 45 through the communication passage 23. The pressure of this refrigerant gas allows the valve body 47 to open the downstream communication passage 23B so that the refrigerant gas is supplied to the suction chamber 4*a*. Accordingly, the pressure Pc in the crank chamber 2*a* drops and is kept at a predetermined level. The high-pressure refrigerant gas in the discharge chamber 4*b* will not reach the communication passage 23 due to the action of the restriction Oa. Consequently only the refrigerant gas having a relatively low pressure, flowing from crank chamber 2*a*, will reach the suction chamber 4*a* via the communication passage 23.

When the suction pressure Ps falls due to a reduction in cooling load, the valve body 47 is moved by the spring 40 in a direction to close the downstream communication passage 23B. This stops the discharging of the refrigerant gas to the suction chamber 4*a* from the crank chamber 2*a*. This further allows the blow-by gas to be supplied to the crank chamber 2*a* from the compression chambers 18 and allows the refrigerant gas to be supplied to the crank chamber 2*a* from the discharge chamber 4*b* via the upstream communication passage 23A, the restriction O and the branch passage 24. Consequently, the crank-chamber pressure Pc rises above the aforementioned set value, increasing the difference ΔPcs between the crank-chamber pressure Pc and the suction pressure Ps. The stroke of the pistons 21 therefore decreases, so that the discharge volume of the compressor decreases in accordance with the reduction in cooling load.

Since the supply of the refrigerant gas into the crank chamber 2*a* and the discharge of the refrigerant gas from the crank chamber 2*a* are also accomplished by the single passage 24 only in this embodiment, the circulation of the refrigerant gas in the crank chamber 2*a* is suppressed, thus suppressing the discharge of the lubricating oil.

The present invention is not limited to the two embodiments, but may be embodied in the following manners.

Figure 6:
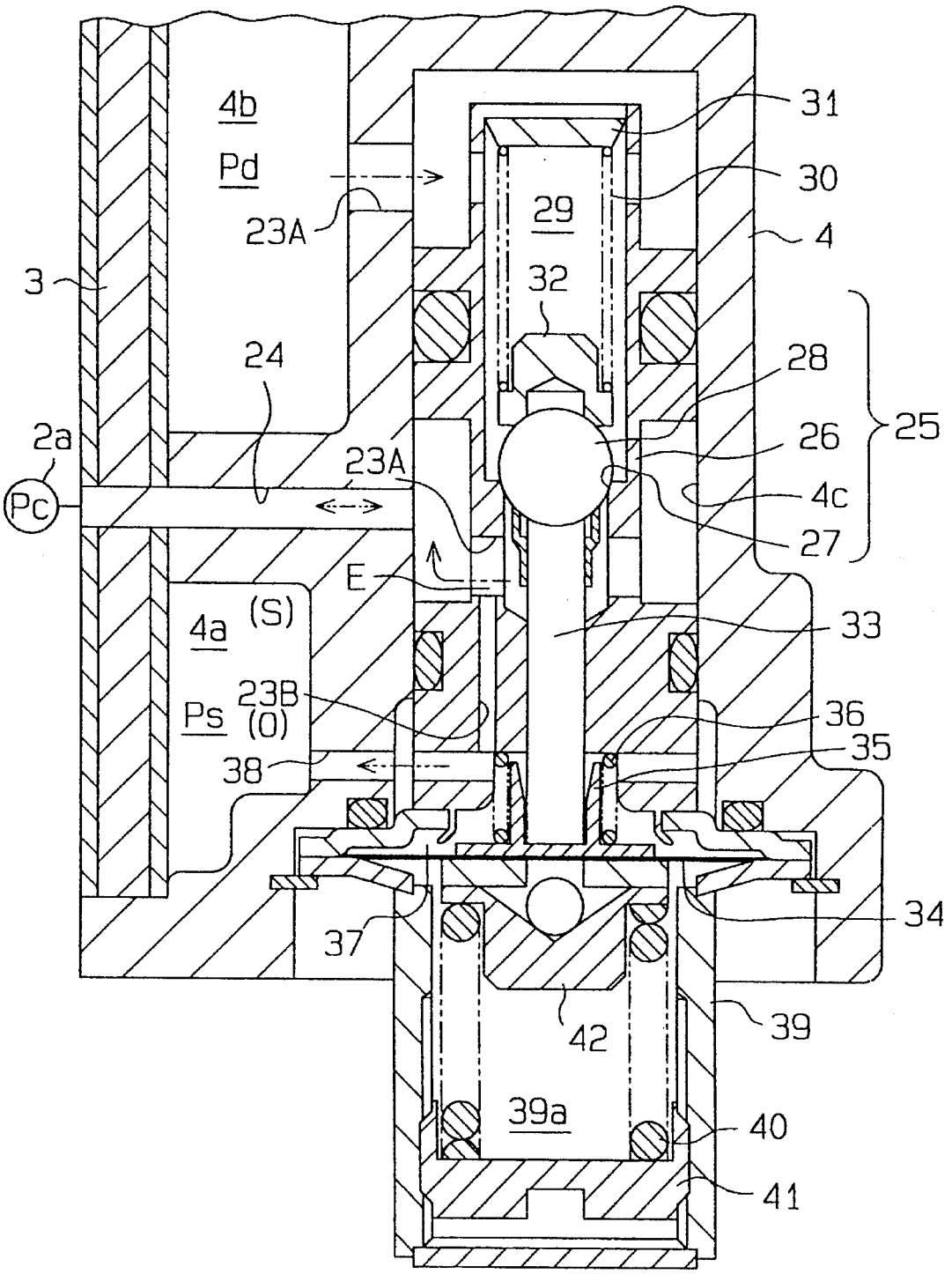
FIG. 6 is a vertical cross-sectional view of a valve according to another embodiment of the present invention.

(1) As shown in FIG. 6, the downstream communication passage 23B serving as the restriction O is formed in the valve body 26 of the valve 25 of the first embodiment in such a way that the passage 23B communicates with the suction chamber 4*a* via the passage 38. The supply of the refrigerant gas into the crank chamber 2*a* will not produce a gas flow in the crank chamber 2*a* in this case either. It is possible to improve the lubricity of the sliding surface of the driving mechanism in the crank chamber. As the downstream communication passage 23B also serves as the restriction in this embodiment, the processing becomes easier.

(2) Although the restriction O is provided in the communication passage in the embodiments, the diameter of the communication passage may be set to achieve a predetermined restriction action, so that the communication passage itself has the restriction effect.

(3) A bellows (not shown) is used in place of the diaphragm 34.

We claim:

1. A swash plate type variable displacement compressor in which a variably inclined swash plate is located in a crank chamber within a housing, the inclination angle of said swash plate being adjustable in accordance with the pressure difference between said crank chamber and a gas suction chamber, and a piston is provided for reciprocation with a stroke related to the inclination angle of said swash plate for compressing gas supplied from said suction chamber to a compression chamber, whereby the volume of gas discharged from a gas discharge chamber is controlled, said compressor comprising:

a communication passage in said housing independent of said crank chamber for connecting said gas discharge chamber to said gas suction chamber without passing through said crank chamber;

a branch passage branching from said communication passage and communicating with said crank chamber;

valve means, disposed in said communication passage between said gas discharge chamber and a point where said branch passage branches from said communication passage, for selectively opening and closing said communication passage to alter the pressure in said crank chamber; and a restriction, provided downstream of said point where said branch passage branches from said communication passage, for throttling the flow of gas from said gas discharge chamber to said gas suction chamber.

2. A swash plate type variable displacement compressor according to claim 1, wherein said valve means is constructed and coupled for connecting said gas discharge chamber to said crank chamber in accordance with a reduction in the pressure in said gas suction chamber.

3. A swash plate type variable displacement compressor according to claim 1, wherein said gas includes a refrigerant gas.

4. A swash plate type variable displacement compressor in which a variably inclined swash plate is located in a crank chamber within a housing, the inclination angle of said swash plate being adjustable in accordance with the pressure difference between said crank chamber and a gas suction chamber, and a piston is provided for reciprocation with a stroke related to the inclination angle of said swash plate for compressing gas supplied from said suction chamber to a compression chamber, whereby the volume of gas discharged from a gas discharge chamber is controlled, said compressor comprising:

a communication passage in said housing independent of said crank chamber for connecting said gas discharge chamber to said gas suction chamber without passing through said crank chamber;

a branch passage branching from said communication passage and communicating with said crank chamber;

valve means, disposed in said communication passage between said gas suction chamber and a point where said branch passage branches from said communication passage, for selectively opening and closing said communication passage to alter the pressure in said crank chamber; and a restriction, provided in said communication passage upstream of said valve means in said communication passage, for throttling the flow of gas from said gas discharge chamber to said communication passage.

5. A swash plate type variable displacement compressor according to claim 4, wherein said valve means is constructed and coupled for connecting said gas suction chamber to said crank chamber in accordance with an increase in the pressure in said crank chamber.

6. A swash plate type variable displacement compressor according to claim 5, wherein said valve means includes means for supplying to said gas suction chamber, when the pressure in said crank chamber exceeds a predetermined value, a quantity of gas corresponding to the excessive pressure in said crank chamber.

7. A swash plate type variable displacement compressor, in which a variably inclined swash plate is located in a crank chamber within a housing, the inclination angle of said swash plate being adjustable in accordance with the pressure difference between said crank chamber and a gas suction chamber, and a piston is provided for reciprocation with a stroke related to the inclination angle of said swash plate for compressing gas supplied from said suction chamber to a compression chamber, whereby the volume of refrigerant gas discharged from a gas discharge chamber is controlled, said compressor comprising:

a communication passage in said housing independent of said crank chamber for connecting said gas discharge chamber to said gas suction chamber without passing through said crank chamber;

a branch passage branching from said communication passage and communicating with said crank chamber;

a valve, disposed in said communication passage between said gas discharge chamber and a point where said branch passage branches from said communication passage, said valve being constructed and coupled for connecting said gas discharge chamber to said crank chamber in accordance with a reduction in the pressure in said gas suction chamber; and a restriction, provided in said communication passage downstream of said point where said branch passage branches from said communication passage, for throttling the flow of refrigerant gas from said communication passage to said gas suction chamber.

8. A swash plate type variable displacement compressor in which a variably inclined swash plate is located in a crank chamber within a housing, the inclination angle of said swash plate being adjustable in accordance with the pressure difference between said crank chamber and a gas suction chamber, and a piston is provided for reciprocation with a stroke related to the inclination angle of said swash plate for compressing gas supplied from said suction chamber to a compression chamber, whereby the volume of refrigerant gas discharged from a gas discharge chamber is controlled, said compressor comprising;

a communication passage in said housing independent of said crank chamber for connecting said gas discharge chamber to said gas suction chamber without passing through said crank chamber;

a branch passage branching from said communication passage and communicating with said crank chamber;

a valve, disposed in said communication passage between said gas suction chamber and a point where said branch passage branches from said communication passage, said valve being constructed and coupled for connecting said gas suction chamber to said crank chamber in accordance with an increase in pressure in said crank chamber; and a restriction, provided in said communication passage upstream of said point where said branch passage branches from said communication passage, for throttling the flow of refrigerant gas into said communication passage from said gas discharge chamber.

* * * * *